US005609265A

United States Patent [19]

Haberkorn et al.

[11] Patent Number: 5,609,265

[45] Date of Patent: Mar. 11, 1997

[54] ADJUSTABLE DRUM AND KEG QUILT

[76] Inventors: Robert W. Haberkorn, 8809 Prestwick La.; John J. Lanigan, 14560 S. Golf, both of Orland Park, Ill. 60462

[21] Appl. No.: 518,867

[22] Filed: Apr. 11, 1995

[51] Int. Cl.[6] ..... B65D 25/34

[52] U.S. Cl. ..... 220/421; 15/901; 220/400; 220/903; 220/739; 220/449

[58] Field of Search ..... 220/421, 400, 220/903, 739, 737, 452, 449, DIG. 1, 454, 455, 456, 457, 461; 219/528, 529, 549, 535; 392/458, 459; 222/105, 183; 40/306, 310; 150/901; 280/47.17, 47.24, 47.26

[56] References Cited

U.S. PATENT DOCUMENTS

| | | | |
|---|---|---|---|
| 107,405 | 9/1870 | Pilkington | 220/449 |
| 1,587,655 | 6/1926 | Kidwell | 150/901 |
| 1,647,169 | 11/1927 | Anton | 150/901 |
| 1,727,530 | 9/1929 | Washburn | 220/452 |
| 1,732,098 | 10/1929 | Lessenhop | 220/452 |
| 3,906,129 | 9/1975 | Damois | 220/400 |
| 4,039,098 | 8/1977 | Stilts | 150/901 |
| 4,282,279 | 8/1981 | Strickland | 220/903 |
| 5,104,700 | 4/1992 | Peterson | 220/452 |
| 5,251,460 | 10/1993 | DeMarco et al. | 220/903 |

*Primary Examiner*—Stephen J. Castellano

[57] ABSTRACT

A drum quilt adapted for insulating a container with temperature sensitive contents from the surrounding environment, having: a substantially tubular open-bottom body including a sidewall section and a top section having a slit portion; the sidewall includes a predetermined diameter defined as a distance from one side of the sidewall to an opposite, other side; and a diameter adjusting mechanism The sidewall diameter is adjustable from a wide diameter (at rest) position to a narrow diameter (pulled taunt) position.

15 Claims, 3 Drawing Sheets

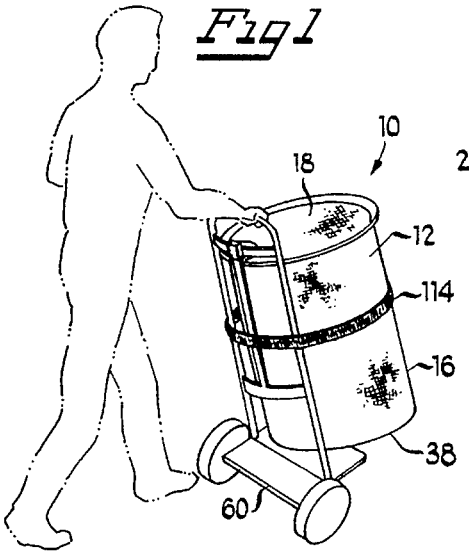
Fig 1
10
18
12
114
16
38
60
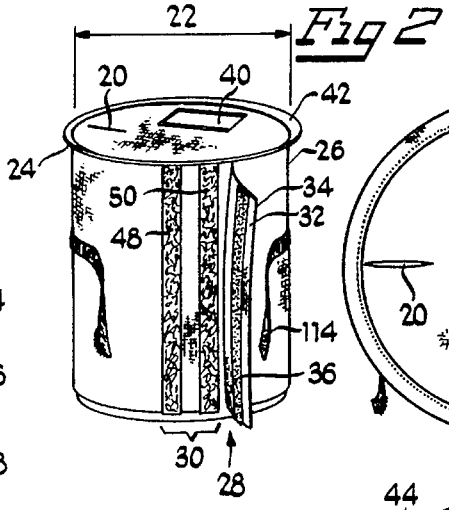
Fig 2
22
20
40
42
24
26
50
34
48
32
114
36
30
28
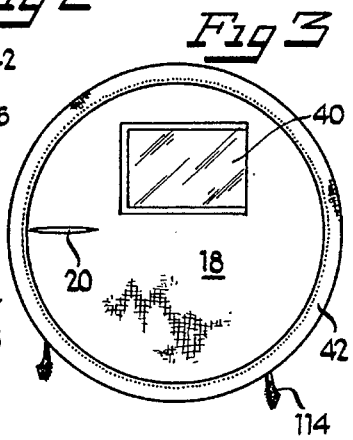
Fig 3
40
20
18
42
114
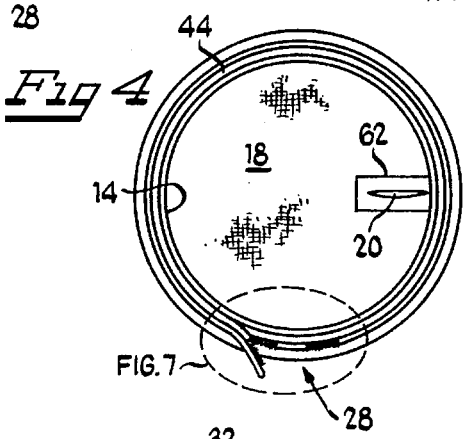
Fig 4
44
62
18
14
20
FIG. 7
28
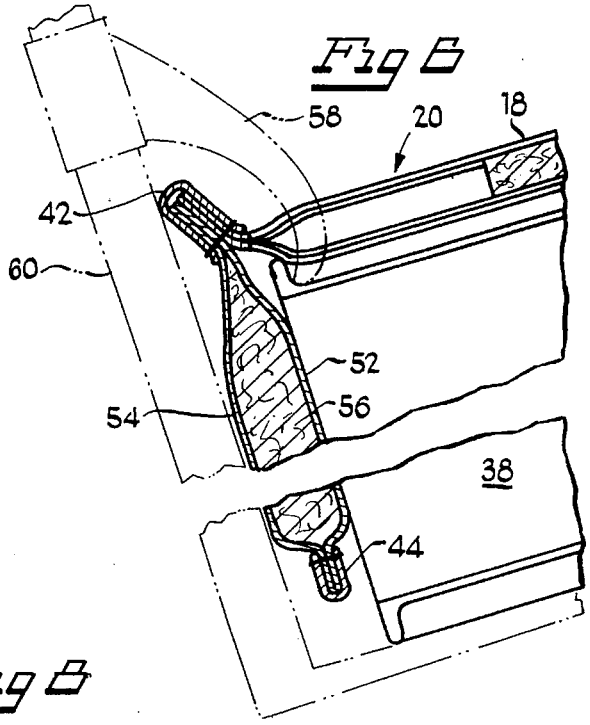
Fig 6
58
20
18
42
60
52
54
56
38
44
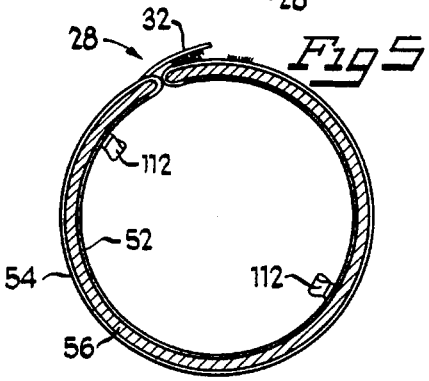
Fig 5
28
32
112
52
54
112
56
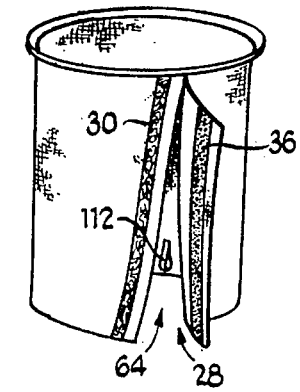
Fig 8
30
36
112
64
28
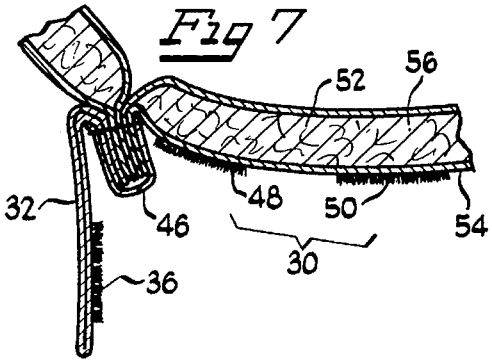
Fig 7
52
56
32
46
48
50
54
30
36

ADJUSTABLE DRUM AND KEG QUILT

FIELD OF THE INVENTION

This invention relates to quilts, and particularly to adjustable drum and keg quilts.

BACKGROUND OF THE INVENTION

There is a need to insulate and provide minimal temperature variations to temperature sensitive materials. A drum or keg quilt that could provide a secure and tight fit around a drum of temperature sensitive material would be considered an improvement. A drum quilt that would provide an insulation air pocket and barrier for minimal temperature loss for the temperature sensitive material or exposure to the outside environment, and further would be self inflatable, would be considered an improvement in the art.

BRIEF DESCRIPTION OF THE DRAWINGS

FIG. 1 is an perspective view of a drum quilt in use, substantially insulating temperature sensitive goods in a drum, shown being transported on a drum hand truck, in accordance with the present invention;

FIG. 2 is a front elevational view of the drum quilt shown in FIG. 1, with an interconnectable structure, in accordance with the present invention;

FIG. 3 is a top plan view of the drum quilt shown in FIG. 1, with a drum strap and window, in accordance with the present invention;

FIG. 4 is a top plan view of an embodiment of the drum quilt shown in FIG. 1, with an interconnectable structure (not shown interconnected) and with a reinforced area surrounding a slit adapted to receive a hook section of a drum hand truck, in accordance with the present invention;

FIG. 5 is a bottom plan view of the drum quilt shown in FIG. 1, with pull down straps adapted to facilitate placement over a drum, in accordance with the present invention;

FIG. 6 is a partial side sectional view of the drum quilt shown in FIG. 1, with a slit with a drum hook inserted therein and therethrough, in accordance with the present invention;

FIG. 7 is a partial enlarged plan cross section of the drum quilt taken from FIG. 4, with a vertical binding and interconnectable structure shown in a disconnected position, in accordance with the present invention;

FIG. 8 is a perspective view of an alternate embodiment of a drum quilt with a side opening and interconnectable structure, shown in an open position, in accordance with the present invention;

DETAILED DESCRIPTION OF THE PREFERRED EMBODIMENT

Figure 10:
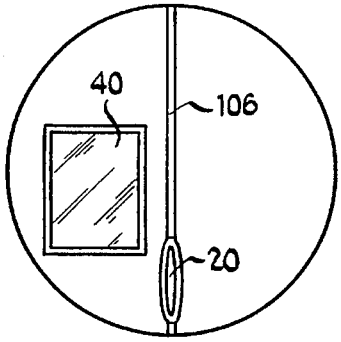
FIG. 10 is a top plan view of the drum quilt shown in FIG. 9, with a top slit, central seam and window, in accordance with the present invention.

Referring to the figures, a drum quilt adapted for insulating a container with temperature sensitive contents from the surrounding environment is shown.

The drum quilt 10 can include: a substantially tubular open-bottom body 12 having an open-bottom 14 including a sidewall section 16 and a top section 18 having a slit portion 20; the sidewall 16 includes a predetermined diameter 22 defined as a distance from one side 24 of the sidewall to an opposite, other side 26; and a diameter adjusting device 28, whereby the sidewall diameter 22 is adjustable from a wide diameter position to a narrow diameter position.

Some of the major advantages of the drum quilt 10, can include the following. It substantially improves the maintainance of a consistant temperature inside the drum quilt, and is less subject to wide temperature variations, as compared to an uninsulated drum. This structure provides a secure and tight fit to a drum 38, for improved insulation. A tight fitting quilt 10, can provide an insulation air pocket and barrier for minimal temperature loss or exposure to the outside environment. More particularly, the quilt 10 provides an inflatable, air barrier insulation provided by the body 12, substantially enveloping the drum 38 and contents from the outside environment. The drum quilt 10 is adjustable to fit conventional or unconventional (irregular) drum or keg sizes. The open-bottom 14 provides for simplified installation and removal.

Additionally, the drum quilt 10 is adaptable to being folded, placed in a package, and can then be express courriered back to a desired location, after use, such as by UPS. And, the drum quilt can be made of a durable material which is adapted to providing some cushioning around the drum during transportation, as well as insulation of the drum contents (temperature sensative) from the elements on a loading dock, or on or in a truck, for example.

In FIG. 1, a fastening belt is shown for attachment to a drum truck 60, for improved transportation and maneuvering of drums.

In one embodiment as shown in FIG. 2, the diameter adjusting device 28 includes at least one outwardly facing interconnectable structure 30 positioned substantially vertically and extending substantially from the top 18 to the bottom 14 on the sidewall 16. A flap section 32 attached to the sidewall 16 can have an inner portion 34 having an inwardly facing interconnectable structure 36, adjustably, interconnectable with the outwardly facing interconnectable structure 30. This structure provides a secure and tight fit to a drum 38, for improved insulation. A tight fitting quilt 10, can provide an insulation air pocket and barrier for minimal temperature loss or exposure to the outside environment. More particularly, the quilt 10 provides an inflatable, air barrier insulation substantially enveloping the drum 38 and contents from the outside environment.

As best shown in FIGS. 2 and 3, the drum quilt 10 can include at least one of the top 18 and the sidewall sections 16 having a substantially clear window 40, adapted to receive a document viewable through the window 40. This structure advantageously provides a clear plastic window, to view a bill of lading on top 18 and when on the sidewall 16, for presenting a Department of Safety placard, a MSDS sheet or the like.

Referring to FIG. 6, the top section 18 and sidewall section 16 can be bound by an upper binding 42, and the open-bottom 14 and sidewall section 16 can be bound by a lower binding 44. This structure provides an outwardly extending resilliant (springy), open-bottom structure for easy placement over and removal from a drum 38. Additionally, this structure provides improved conformance to the drum 38, because the bindings 42 and 44 tend to extend outwardly, and the adjustment structure 28 improves a tight envelop and insulation barrier around the drum 38.

As best shown in FIG. 7, a substantially vertical sidewall binding 46 can connect the flap 32 with the sidewall section 16, which is adapted to provide a durable structure, to securely fit around a wide diameter or narrower diameter drum structure. By connecting the structure 36 to one of the outwardly facing structures 48 and 50, for example, a tight fit is obtainable. In a preferred embodiment, the structures 30, 36, 48 and 50 include strips of interconnectable structures, such as Velcro and the like, for easy adjustment.

As illustrated in FIGS. 6 and 12–15, the body 12 includes an interior portion or layer 52, an exterior portion or layer 54 and an insulative portion or layer 56. Advantageously, each contributes to the body's durability and resistance to abrasion. A tight fitting quilt 10 with the desired body 12 construction, can provide an insulation air pocket and barrier for minimal temperature loss or exposure to the outside environment. More particularly, a suitable body 12 construction provides a self-inflatable, air barrier insulation substantially enveloping the drum 38 and contents from the outside environment.

In FIG. 6, the drum quilt 10 has a slit portion 20 preferably positioned on the top 18 adjacent to a portion of the sidewall 16, adapted to receive a hook portion 58 of a drum truck 60, for facilitating transportation of a drum with temperature sensative contents. The placement near the sidewall 16, helps to facilitate connection and removal of the hook 58, from the slit 20 and drum 38. Another feature of the drum quilt 10, is that the slit 20 has an automatic closing at rest feature, or self closing feature (when not in use), to substantially maintain the desired insulation and temperature in the drum, as shown in FIG. 4.

The slit 20 can include a reinforcement layer or area 60, for improved integrity. More specifically, the slit portion 20 and reinforcement area 62, include a normally closed condition (action), to allow manipulation of the drum 38 in use during transportation, and will spring back closed after removal of the hook portion 58 of the drum truck 60.

In FIG. 8, the sidewall section 16 has an open-side portion 64, for simplified placement and removal in certain applications.

Figure 9:
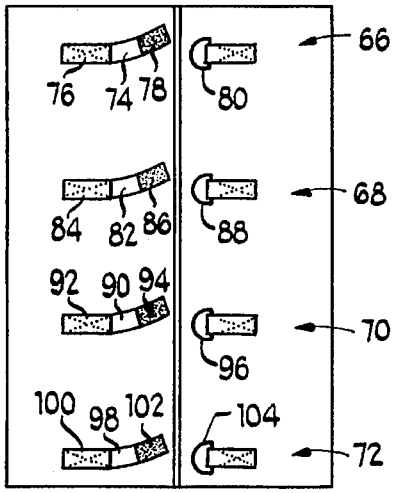
FIG. 9 is a front side view of a preferred embodiment of a drum quilt with an interconnectable structure including adjustable securement straps and rings, in accordance with the present invention.

As shown in FIG. 9, the sidewall section 16 can include one or more interconnectable structures which are adjustably connected, for simplified diameter adjustment. This structure can accomadate one of many different diameters and configurations, ie. two or more different diameter drums or kegs, for example.

In a preferred embodiment, the sidewall section 16 includes at least one substantially adjustable securement device, substantially as shown in the figures. More particularly, the securement device can include a plurality of strap and ring securement devices, substantially as shown in FIG. 9.

In this embodiment, four equi-spaced securement devices, identified as items 66, 68, 70, and 72, are shown securely attached, such as sown directly to the sidewall section 16. This embodiment provides independant adjustment along various heights, for improved insulating and enveloping around the drum. Moreover, the strap and ring securement devices 66, 68, 70, and 72, provide for: (i) improved securement; (ii) ease of adjustment for a tighter and a firmer fit to a drum; and (iii) an improved system of insulating the temperature sensitive material in a keg, drum, container or the like. Additionally, the drum quilt 10 provides a self inflating air pocket and barrier, for further insulation between the temperature sensitive contents and the outside environment.

The diameter adjusting devices 66, 68, 70, and 72, include a number of vertically spaced belts and adjacent loops for individual adjustment of the diameter of the sidewall section, to accomodate standard or irregularly configured drums. More specifically, a first securement device 66 includes a first strap 74 with proximal and distal interconnectable structures 76 and 78, and adjacent anchor ring 80. The second securement device 68 includes a second strap 82 with proximal and distal interconnectable structures 84 and 86, and adjacent second anchor ring 88. The third securement device 70 includes a third strap 90 with proximal and distal interconnectable structures 92 and 94, and an adjacent third anchor ring 96. And finally, the fourth securement device 72 includes a fourth strap 98 with proximal and distal interconnectable structures 100 and 102, and adjacent fourth anchor ring 104. The securement devices are generally sewn or appropriately attached to the sidewall 16.

In a preferred embodiment, the securement devices 66, 68, 70 and 72, comprise Velcro, which is a commonly known interconnectable material. However, other structures can be used, such as but not limited to snapable belts, zippers, button and hole arrangements, and the like, as should be appreciated by those skilled in the art.

In FIG. 10, a top view of the drum quilt 10 in FIG. 9 is shown, with a window 40, center seam 106 and slit 20, for simplified replacement, in the event of damage to the top section 20. Another benefit to the drum quilt 10, is that it is substantially modular or made with replaceable components, for ease assembly and/or replacement and repair of component parts, if needed.

Figure 11:
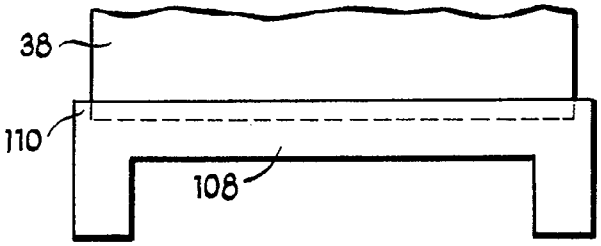
FIG. 11 is a sectional view of a bottom portion for use in connection with the drum quilt, in accordance with the present invention.

In FIG. 11, a cross-sectional view of a bottom portion 108. It can be made of an insulative material for improved insulation. Also, the bottom portion is adapted to minimize damage to the bottom of a drum when abruptly set down, for example. The bottom 108 is configured to receive a substantially conventionally shaped drum in an upperwardly facing receptacle section 110. In one embodiment, the bottom 108 comprises recycled tires or rubber.

Figure 12:
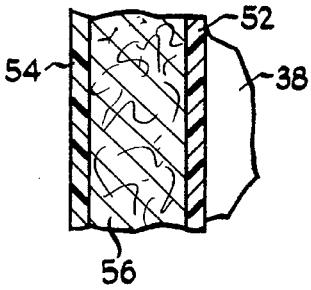
FIG. 12 is a partial side sectional view of an embodiment of the drum quilt shown in FIG. 1, with a three layer body, in accordance with the present invention.

Referring to FIGS. 12–15, various body 12 constructions are shown. In FIG. 12, a single trip, substantially recyclable body construction is shown, as detailed previously, with interior layer 52, exterior layer 54 and insulative layer 56.

In a preferred embodiment, the body 10 includes: an interior layer 52 comprising a coated spun bonded polypropelene, preferably Typar model 3153 from Reemay; an exterior portion or layer 54 also comprising the same as above (a coated spun bonded polypropelene, preferably Typar model 3153 from Reemay); and an insulative portion 56 comprising-a polypropelene, polyester, or the like, preferably a Dupont 808 material, also known as Holofil. This is believed to be made of a polypropelene material. This construction provides for improved consistancy and self-inflatable body structure, after being crushed and folding during its life. The combination provides a self-forming and resillient, configuration and structure, which helps to keep the temperature sensitive material warm, hot or cold, as desired.

More specifically, the insulative portion 56 can comprise a plurality of individual layers of materials, for improved isolation of the temperature sensitive material from the environment.

Figure 13:
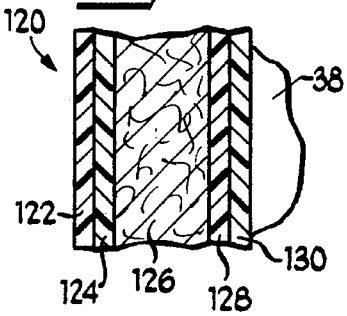
FIG. 13 is a partial side sectional view of an embodiment of the drum quilt shown in FIG. 1, with a five layer body, in accordance with the present invention.
Figure 15:
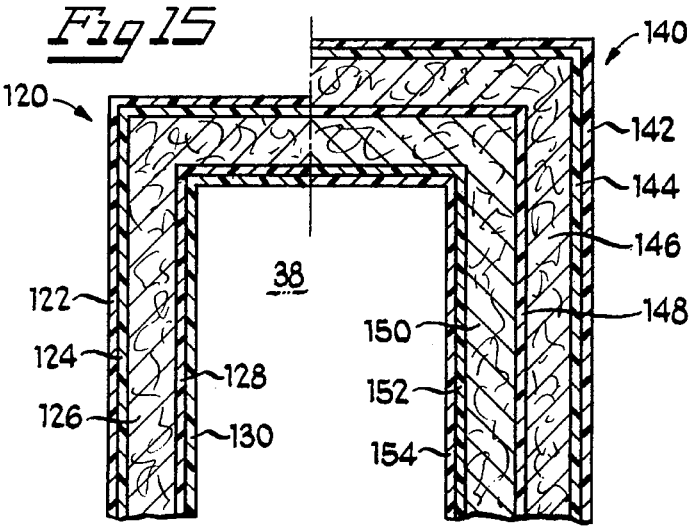
FIG. 15 is a partial side sectional view of an embodiment of the drum quilt shown in FIGS. 1, 9, 13 and 14 with preferred five (on the left) and seven layer bodys (on the right), in accordance with the present invention.
Figure 16:
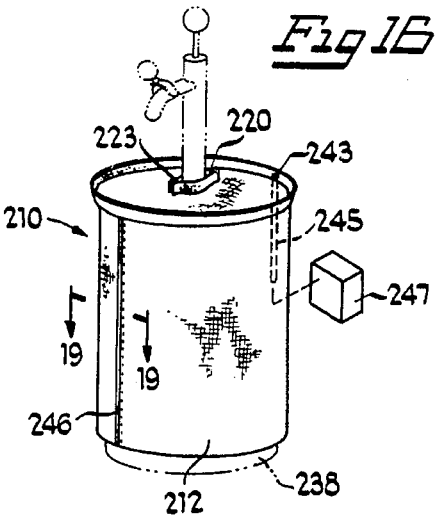
FIG. 16 is a perspective view of a keg quilt in use, insulating goods in a keg, in accordance with the present invention.
Figure 19:
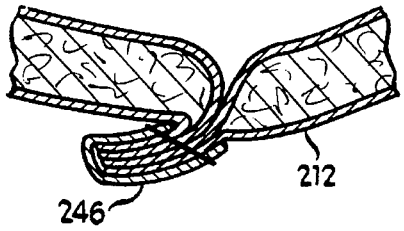
FIG. 19 is a partial sectional view of the keg quilt shown in FIG. 16, along the lines 19—19, with a vertical binding, in accordance with the present invention.
Figure 17:
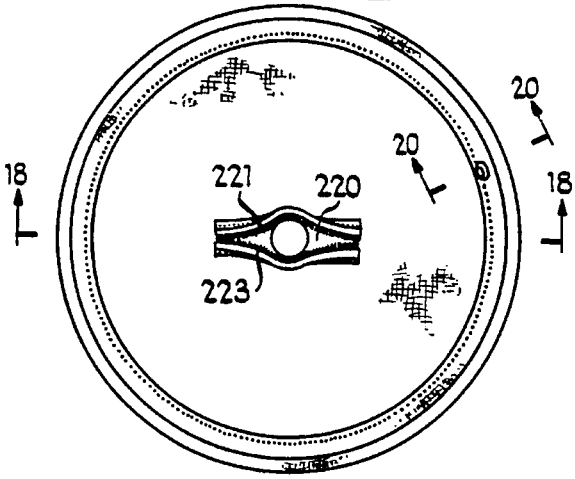
FIG. 17 is a top plan view of the keg quilt shown in FIG. 16, in accordance with the present invention.
Figure 20:
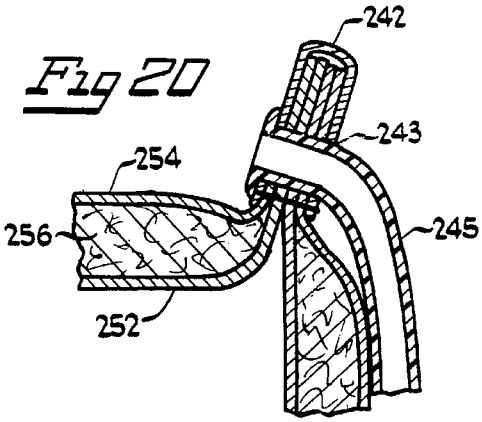
FIG. 20 is a partial sectional view of the keg quilt shown in FIG. 17, along the lines 20—20, with an opening through the binding and tube operably connected to a reservoir, in accordance with the present invention.
Figure 21:
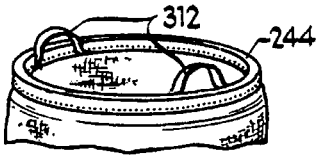
FIG. 21 is a partial perspective view of a bottom portion of the keg quilt in FIG. 16, with pull down straps and a lower binding, in accordance with the present invention.
Figure 18:
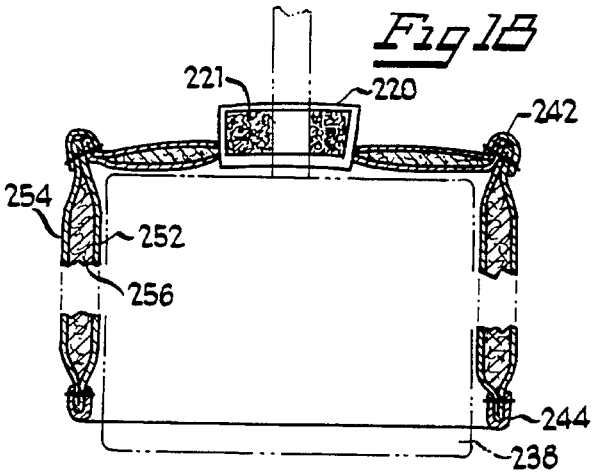
FIG. 18 is a partial side sectional view of the keg quilt shown in FIG. 17, along the lines 18—18, showing a center slit and top and bottom bindings, in accordance with the present invention.

In FIGS. 13 and 15, a multi-trip, (commonly referred to as therma-grade construction), multi-layer construction 120, body 12 is shown. This therma-grade construction 120 can vary widely. In a preferred embodiment, the individual layers include a first layer 122, preferably of a vinyl coated polyester or nylon, most preferably Imperial 600 from Nassimi Corp., in N.Y., N.Y.; second and fourth layers 122 and 128 of preferably a spun bonded material such as Typar; a third layer 126 of a Holofil or spun bonded material, most preferably a Dacron Dupont 808 polyester material; and a fifth layer 130 comprising a coated polyester, such as a vynal coated nylon, such as Imperial 200 from Nassimi Corp. This construction provides a durable, self inflatable and resilient (springy) body 12, for improved placement and removal.

Figure 14:
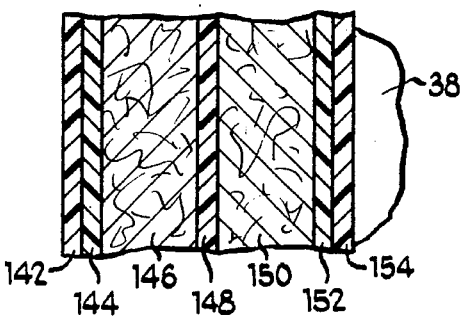
FIG. 14 is a partial side sectional view of an embodiment of the drum quilt shown in FIG. 1, with a seven layer body, in accordance with the present invention.

In FIG. 14 and 15, a seven layer body construction 140, is shown with layers 142, 144, 146, 148, 150, 152, and 154, from the exterior to interior layers. In a preferred embodiment, the individual layers include a first layer (exterior) 142 and seventh interior layer 154, each comprising a vynal coated polyester, preferably Imperial 600 (denier) and vynal coated nylon material preferably Imperial 200, respectively; the second layer 144 , fourth layer 148 and sixth layer 152 can comprise a spun-bonded or Typar material; and the third and fifth layers 146 and 150, can comprise a spun bonded material or Holifil, preferably Dacron Dupont 808 polyester holifil, for providing a recycleable drum quilt, which can contribute to saving fuels and the like, by improved insulation.

The multi layer constructions provide improved insulation, self inflating constructions which facilitate placement and removal, because of the resillient nature of the body 12, made with these constructions. A Nylon interior layer helps to facilitate placement on a drum, and a Vynal outer layer provides a durable exterior.

In one embodiment, pull down means, preferably in the form of opposite and interior pull-down straps 112 are utilized, as shown in FIGS. 5 and 8, for facilitating placement over a drum or keg, for example.

Thus, the drum quilt 10 is particularly adapted for insulating a container with temperature sensitive contents from the surrounding environment. In one application, it includes: a substantially tubular open-bottom body 12 having an open-bottom 14 including a sidewall section 16 and a top section 18 having a slit portion 20; the sidewall 16 includes a predetermined diameter defined as a distance from one side 24 of the sidewall to an opposite, other side 26; and a diameter adjusting device (securement device) as shown in the figures, whereby the sidewall diameter is adjustable from a wide diameter (at rest) position to a narrow (pulled taunt) position.

In FIGS. 16–21, a drum quilt in the form of a keg quilt 210, is shown. It is adapted for insulating a container/keg 238 with temperature sensitive contents, such as pop or beer from the surrounding environment It can comprise: a substantially tubular open-bottom body 212 having an open-bottom 214 including a sidewall section 216 and a top section 218 having a slit portion 220; the sidewall 216 includes a predetermined diameter defined as a distance from one side 224 of the sidewall to an opposite, other side 226; and a substantially upwardly extending, upper binding 242 having a port 243 connectable to a resevoir 247 for receiving liquid.

In one embodiment, the open-bottom 214 and sidewall section 216 are bound by a lower binding 244. The keg quilt 210 contributes to minimizing waste by catching spilled liquid. The outer layer can include a substantially reflective layer to reflect the sunlight and the like, for improved insulation.

The difference between the drum quilt in FIG. 1 and the keg quilt 210, is the placement of the slit 220 in a substantially middle portion of the top section, and preferably includes first and second interconnectable sections 221 and 223 to adjustably close the slit 220, to maximize insulation. Most of the rest of the keg quilt 210 is substantially similar to the structure of the drum quilt 10, and thus the item numbers are similar but include two hundred, for simplicity ( ie. drum quilt 10 and keg quilt 210, etc.)

Although various embodiments of the invention have been shown and described, it should be understood that various modifications and substitutionns, as well as rearrangements and combinations of the preceding embodiments, can be made by those skilled in the art.

What is claimed is:

1. A drum quilt adapted for insulating a container with temperature sensitive contents from the surrounding environment, comprising:

a substantially tubular open-bottom body having an open-bottom including a sidewall section and a top section having a slit portion, the slit portion is positioned adjacent to a portion of the sidewall and adapted to receive a hook portion of a drum truck, for facilitating transportation thereof;

the sidewall includes a predetermined diameter defined as a distance from one side of the sidewall to an opposite, other side; and a diameter adjusting device whereby the sidewall diameter is adjustable from a wide diameter potation to a narrow diameter position.

2. The drum quilt of claim 1, wherein the diameter adjusting device includes at least one outwardly facing interconnectable structure positioned substantially vertically and extending substantially from the top to the open-bottom on the sidewall and a flap section attached to the sidewall having an inner portion having an inwardly facing interconnectable structure adjustably, interconnectable with the outwardly facing interconnectable structure.

3. The drum quilt of claim 1, wherein at least one of the top and the sidewall sections includes a substantially clear window adapted to receive a document viewable through the window.

4. The drum quilt of claim 1, wherein the top section and sidewall section are bound by an upper binding, and the open-bottom and sidewall section are bound by a lower binding.

5. The drum quilt of claim 1, wherein a substantially vertical sidewall binding connects a flap with the sidewall section.

6. The drum quilt of claim 1, wherein the body includes an interior portion, an exterior portion and an insulative portion.

7. The drum quilt of claim 1, wherein an area substantially immediately surrounding the slit is reinforced.

8. The drum quilt of claim 1, wherein the sidewall section includes a flap with an inwardly facing interconnectable structure disconnectably, connected with an outwardly facing interconnectable structure on the sidewall section.

9. The drum quilt of claim 1, wherein the sidewall section has an open-side portion.

10. The drum quilt of claim 1, wherein the sidewall section includes at least one belt.

11. A drum quilt adapted for insulating a container with temperature sensitive contents from the surrounding environment, comprising:

a substantially tubular open-bottom body having an open-bottom including a sidewall section and a top section having a slit portion;

the sidewall includes a predetermined diameter defined as a distance from one side of the sidewall to an opposite, other side; and a diameter adjusting device whereby the sidewall diameter is adjustable from a wide diameter position to a narrow diameter position, the diameter adjusting device includes a plurality of vertically spaced belts and adjacent loops for individually adjusting the diameter of the sidewall section.

12. The drum quilt of claim 11, wherein the body includes:

an interior portion and an exterior portion comprising the same material, and an insulative portion.

13. The drum quilt of claim 12, wherein the insulative portion comprises a plurality of individual layers of materials.

14. The drum quilt of claim 13, wherein the individual layers include a first exterior layer, a second substantially insulative layer and a third interior layer.

15. The drum quilt of claim 13, wherein the individual layers include at least five individual layers.

* * * * *